US006042104A

United States Patent [19]

Nishikori et al.

[11] Patent Number: 6,042,104

[45] Date of Patent: Mar. 28, 2000

[54] SHEET SUPPLYING APPARATUS

[75] Inventors: Toshihiko Nishikori, Kawasaki; Mamoru Takai; Eiichi Motai, both of Yokohama; Hiroyuki Tamaki, Kawasaki, all of Japan

[73] Assignee: Canon Kabushiki Kaisha, Tokyo, Japan

[21] Appl. No.: 08/923,525

[22] Filed: Sep. 4, 1997

[30] Foreign Application Priority Data

Sep. 5, 1996 [JP] Japan ..... 8-253957
Jul. 24, 1997 [JP] Japan ..... 9-198175

[51] Int. Cl.[7] ..... B65H 3/52

[52] U.S. Cl. ..... 271/121; 271/109; 271/117; 271/124

[58] Field of Search ..... 271/109, 117, 271/118, 119, 121, 124

[56] References Cited

U.S. PATENT DOCUMENTS 5,729,788 3/1998 Hirohashi et al. ..... 399/66

FOREIGN PATENT DOCUMENTS 0098536 4/1989 Japan ..... 271/121
0294132 11/1989 Japan ..... 271/119

*Primary Examiner*—H. Grant Skaggs
*Attorney, Agent, or Firm*—Fitzpatrick, Cella, Harper & Scinto

[57] ABSTRACT

The present invention provides a sheet supplying apparatus comprising a main frame, a sheet supporting device provided within the main frame to support a sheet, a sheet supply rotary device for feeding out the sheet supported by the sheet supporting device, a recovery device attached to the main frame to recover a sheet supplying force of the sheet supply rotary device, and a switching device for shifting the recovery device between a recovery position to be abutted against the sheet supply rotary device to effect a recovery operation and a waiting position to be spaced apart from the sheet supply rotary device.

21 Claims, 17 Drawing Sheets

SHEET SUPPLYING APPARATUS

BACKGROUND OF THE INVENTION

1. Field of the Invention

The present invention relates to a sheet supplying apparatus in which a sheet is separated and supplied from a plurality of stacked sheets and which is used with an image forming apparatus such as a printer, a copying machine and the like.

2. Related Background Art

In conventional image forming apparatuses (for example, printers), there is provided an auto sheet feeder (ASF) as a sheet supplying apparatus for separating and supplying a single sheet from a plurality of stacked sheets (such as paper sheets).

In such an auto sheet feeder, there is provided a sheet supply roller (pick-up roller) or a sheet supply belt for supplying an uppermost sheet or a lowermost sheet from a sheet stack (stacked sheets) while applying a frictional force to the sheet, and, a bank or separation pawl(s) is provided for separating a single sheet to prevent a plurality of sheets from being supplied together with the uppermost or lowermost sheet, or, pads having high coefficient of friction (separation pads) are provided in a confronting relation to the sheet supply roller to prevent the other sheets from shifting together with the uppermost or lowermost sheet.

However, in the above-mentioned conventional techniques, if a surface of the sheet supply roller or the sheet supply belt is degenerated or hardened (due to reduction in coefficient of friction) for long term use, since a frictional force (between the sheet supply roller and the sheet) is reduced not to achieve the proper sheet supply. Further, when paper powder (from the sheet) and/or dirt is adhered to the surface of the sheet supply roller, the frictional force is also reduced not to achieve the proper sheet supply.

In order to eliminate the poor sheet conveyance due to the above causes, the sheet supply roller or the sheet supply belt must be dismounted from the apparatus to clean it or to polish the surface thereof by a grinding sheet kit, the maintenance is worsened.

Further, in recent years, ink jet printers have been developed as compact printers. In such ink jet printers, a sheet having a coating (for example, silica) layer at its recorded surface is sometimes used for the purpose of controlling the ink fixing ability and ink blotting. In this case, the coating material is adhered to the surface of the sheet supply roller in addition to the paper powder to reduce the sheet supplying force to thereby cause the poor sheet supply.

SUMMARY OF THE INVENTION

The present invention intends to eliminate the above-mentioned conventional drawbacks, and has an object to provide a sheet supplying apparatus and an image forming apparatus, in which a sheet can be properly conveyed by restoring a reduced friction force and which can provide a high quality image and good maintenance.

To achieve the above object, according to the present invention, there is provided a sheet supplying apparatus comprising a main frame, a sheet supporting means provided within the main frame for supporting a sheet, a sheet supply rotary means for feeding out the sheet supported by the sheet supporting means, a recovery means attached to the main frame for recovering a sheet supplying force of the sheet supply rotary means, and a switching means for shifting the recovery means between a recovery position where the recovery means abuts against the sheet supply rotary means to effect a recovery operation, and a waiting position where the recovery means is spaced apart from the sheet supply rotary means.

Further, the present invention may provide a sheet supplying apparatus comprising a main frame, a sheet supporting means provided within the main frame for supporting sheets, a sheet supply rotary means for feeding out the sheet supported by the sheet supporting means, a friction member disposed on the sheet supporting means at a position confronting to the sheet supply rotary means and contacted with a lowermost sheet among the sheets supported by the sheet supporting means, a recovery means for recovering a sheet supplying force of the sheet supply rotary means, and a switching means for selectively shifting the friction member or the recovery means to a position confronting to the sheet supply rotary means.

BRIEF DESCRIPTION OF THE DRAWINGS

FIG. 9A shows a schematic construction and FIG. 9B shows a sheet supplying condition;

FIG. 10A shows a polishing operation and FIG. 10B shows a cleaning operation;

FIG. 11A shows a schematic construction and FIG. 11B shows a sheet supplying condition;

FIG. 12A shows a polishing operation and FIG. 12B shows a cleaning operation;

FIG. 13A shows a schematic construction and FIG. 13B shows a sheet supplying condition;

FIG. 14A shows a polishing operation and FIG. 14B shows a cleaning operation;

DETAILED DESCRIPTION OF THE PREFERRED EMBODIMENTS

First of all, the entire construction of an image forming apparatus will be explained, and then, the construction of a sheet supplying apparatus will be explained.

<Image Forming Apparatus>

Figure 3:
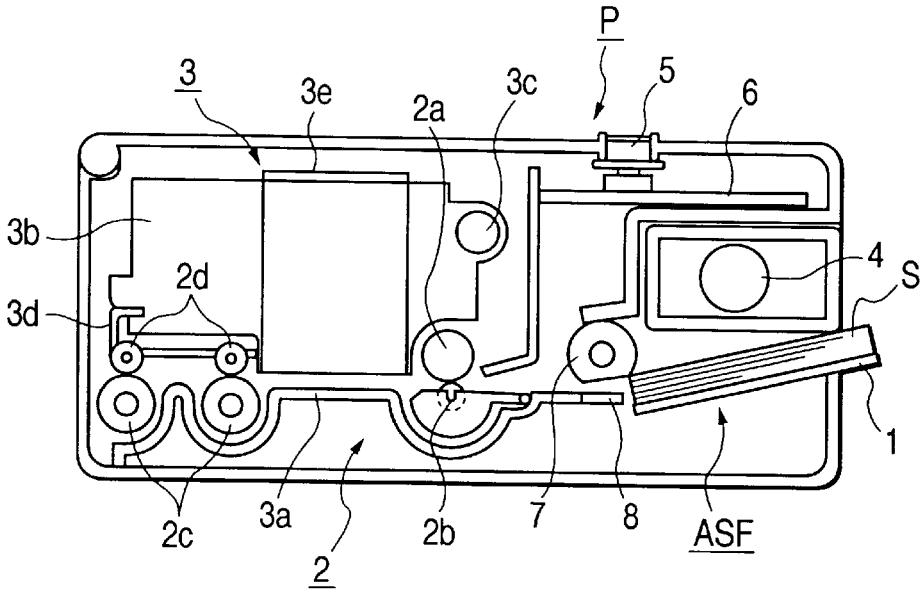
FIG. 3 is a schematic sectional view of an ink jet image forming apparatus (image forming apparatus) having a sheet supplying apparatus.

As shown in FIG. 3, an image forming apparatus P according to a preferred embodiment of the present invention is embodied as an ink jet printer of ink jet recording type. After a plurality of sheets S are stacked on a sheet supply tray 1, when a recording operation is started, the sheets S are separated and supplied one by one by a sheet supplying apparatus ASF which will be described later. The supplied sheet S is conveyed, by a convey means 2, to a recording area, where a predetermined image is formed on the sheet by an image forming means 3. Thereafter, the sheet is discharged out of the printer.

The convey means 2 comprises a convey roller 2*a* for conveying the supplied sheet S to the recording area, a pinch roller 2*b* urged against the convey roller and driven by the rotation of the convey roller, a discharge roller 2*c* for discharging the recorded sheet S out of the printer, and a spur roller 2*d* urged against the discharge roller and driven by the rotation of the discharge roller. Incidentally, the spur roller 2*d* is rotated while contacting with the imaged (recorded) surface of the sheet S but has a smaller contact area with the sheet S so that, even when the spur roller is contacted with the ink imaged surface of the sheet S, the ink image is not distorted.

In the illustrated embodiment, an ink jet recording system is used as the image forming means 3. More specifically, the image forming means includes a platen 3*a* for supporting a rear surface (non-imaged surface) of the sheet S to be conveyed, and a carriage 3*b* disposed in a confronting relation to the platen. The carriage 3*b* is reciprocally shifted by a motor (not shown) in a sheet width-wise direction (perpendicular to a sheet conveying direction) along a long guide shaft 3*c* and a guide rail 3*d*, and an ink cartridge 3*e* integrally incorporating an ink jet recording head and an ink tank is removably mounted on the carriage 3*b*. By shifting the carriage 3*b* and by discharging ink from the recording head, a predetermined image is recorded on the sheet S. The recording head includes fine liquid discharge openings (orifices), liquid passages communicating with the respective discharge openings, energy acting portions disposed in the respective liquid passages, and energy generating means for generating liquid droplet forming energy acting on the liquid in the acting portions.

In the illustrated embodiment, the ink is discharged from the discharge opening of the recording head by growth and contraction of a bubble generated in the ink by film boiling of the ink caused by thermal energy produced by applying current to an electrical/thermal converter in response to a recording signal to thereby effect the recording. Further, the recording head is movable so that a distance between an ink discharge surface (including the discharge opening) of the head and the sheet S can be adjusted in accordance with a thickness of the sheet S.

The sheet supplying apparatus ASF, convey means 2 and image forming means 3 are driven by a battery (power source) 4, and the driving thereof is controlled by a control means provided on a control board 6 in accordance with command from an operation panel 5.

As shown in FIGS. 1A to 1D, 2 and 3, the sheet supplying apparatus ASF for separating and supplying the sheets S one by one includes a pick-up roller (sheet supply rotary member) 7 for applying a sheet supplying force to the sheet S, separation pads (separation members) 8 for separating the sheets S supplied by the pick-up roller 7, and a recovery means 9 for recovering reduction in the sheet supplying force of the pick-up roller 7.

The pick-up roller 7 has two rubber roller portions. A coefficient of friction between the pick-up roller and the sheet is greater than a coefficient of friction between the sheets. When the pick-up roller is rotated by the motor, the sheet supplying force is applied to the sheet S from the pick-up roller. The pick-up roller 7 is rotatably supported by a pivotable arm for up-and-down movement in accordance with the sheet picking-up operation.

The separation pads 8 are formed from material having high coefficient of friction and serve to urge the sheets S against the pick-up roller 7 so that, even if a plurality of sheets are supplied by the pick-up roller 7, the supply of the sheets other than an uppermost sheet is prevented. Thus, only the uppermost sheet is separated and supplied.

The recovery means 9 serves to recover the reduction in the sheet supplying force of the pick-up roller 7 and includes a cleaning means for cleaning a surface of the pick-up roller 7 when silica coated on the sheet S and/or paper powder are adhered to the surface of the pick-up roller 7, and a polishing means for polishing the surface of the pick-up roller 7 when the surface of the pick-up roller 7 is degenerated or hardened.

The cleaning means includes two cleaning pads 9*a* attached to a plate-shaped holder 10 at positions in a confronting relation to two rubber roller portions of the pick-up roller 7, and the polishing means includes two polishing pads 9*b* attached to the plate-shaped holder 10 at positions in a confronting relation to two rubber ruller portions of the pick-up roller 7.

The cleaning means may be of dry cleaning type for cleaning in a dry condition or of wet cleaning type for cleaning by using cleaning liquid, but the wet cleaning is more effective than the dry cleaning. The cleaning pad may be formed from hydrophilic non-woven fabric or plastic obtained by sintering polyorefin particles. The cleaning liquid impregnated into the cleaning pad may be ethanol or water which has high contamination removing ability and high friction force recovering ability.

The polishing means may be formed from a member having hardness greater than that of the roller to be polished and having a rough surface. For example, a "sand paper" obtained by adhering particle polishing agent to a sheet substrate, a member obtained by adhering polishing agent to nylon or polyester nonwoven fabric, a member obtained by adhering particle polishing agent to a polyester sheet, or porous member (for example, porous plastic obtained by sintering polyorefin particles of about 100 $\mu$m) may be used.

Incidentally, the surfaces of the cleaning pads 9*a* and the polishing pads 9*b* are positioned below a contact surface between the separation pad 8 and the pick-up roller 7 so that the pads 9*a*, 9*b* do not affect a bad influence upon the sheet S during the sheet supplying operation.

The holder 10 to which the cleaning pads 9*a* and the polishing pads 9*b* are attached is provided at its lower surface with a rack 10*a* which is engaged by a pinion gear 11 provided on a main frame of the apparatus, so that, when the pinion gear 11 is rotated by a motor (not shown), the holder are slid in a left-and-right direction in FIGS. 1A to 1D.

Figure 1A:
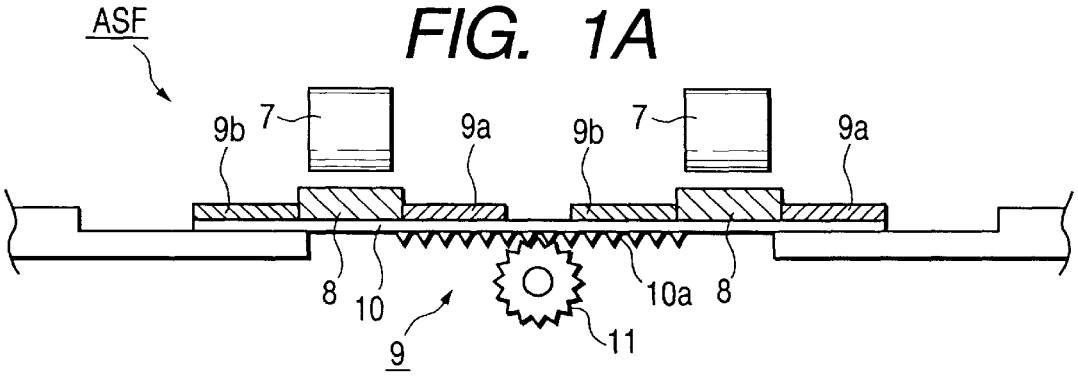
FIGS. 1A, 1B, 1C and 1D are explanatory views for explaining an operation of a sheet supplying apparatus.
Figure 1B:
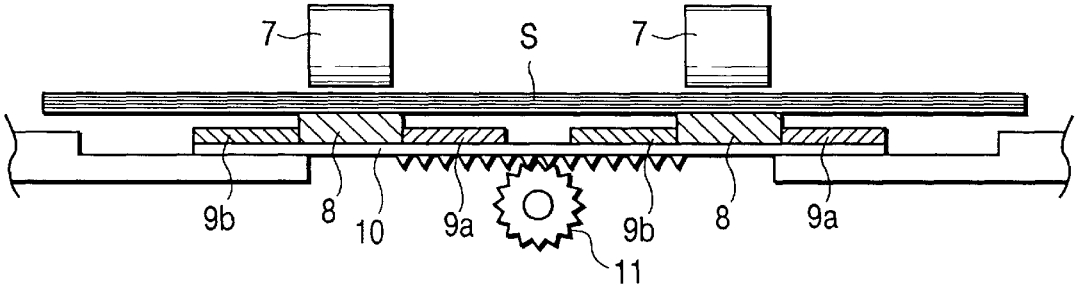

Next, an operation of the sheet supplying apparatus ASF will be explained with reference to FIGS. 1B to 1D. FIG. 1B shows a normal sheet supplying condition. In this condition, the separation pads 8 are opposed to rubber roller portions of the pick-up roller 7 to cooperate with the latter to separate the sheets S one by one.

Figure 1C:
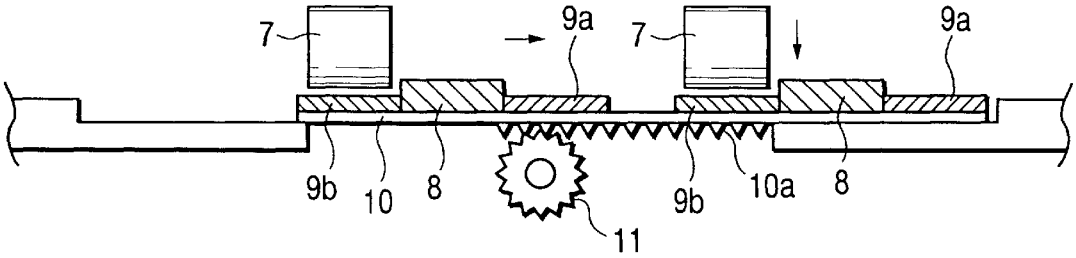
Figure 1D:
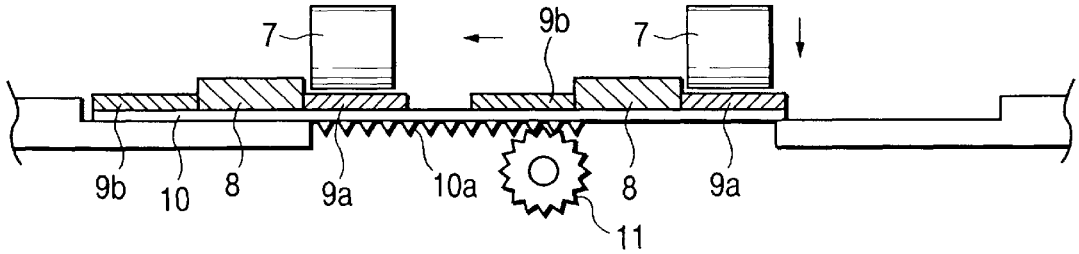

When the surface of the pick-up roller 7 is degenerated or hardened to reduce the sheet supplying force for the long term use, as shown in FIG. 1C, the pinion gear 11 is rotated to slide the holder 10 to the right to thereby oppose the polishing pads 9*b* to the rubber roller portions of the pick-up roller 7. Then, the pick-up roller 7 is lowered to urge it against the polishing pads 9*b* and is rotated. Thus, the surface of the pick-up roller 7 is polished by the polishing pads 9*b* to thereby scrape the degenerated or hardened surface of the pick-up roller.

Thereafter, the pick-up roller 7 is lifted. Then, as shown in FIG. 1D, the holder 10 is slid to the left to oppose the cleaning pads 9*a* to the rubber roller portions of the pick-up roller 7. And, similar to the polishing pads 9*b*, the pick-up roller 7 is urged against the cleaning pads 9*b* and is rotated. In this way, paper powder and/or coating silica adhered to the surface of the pick-up roller 7 or chips scraped by the polishing pads 9*b* are removed.

By operating the recovery means in this way, the coefficient of friction of the surface of the pick-up roller 7 can be recovered to thereby restore the sheet supplying force.

While an example that, in the recovery operation, the polishing operation is immediately followed by the cleaning operation was explained, the polishing operation and the cleaning operation may be performed independently.

Figure 2:
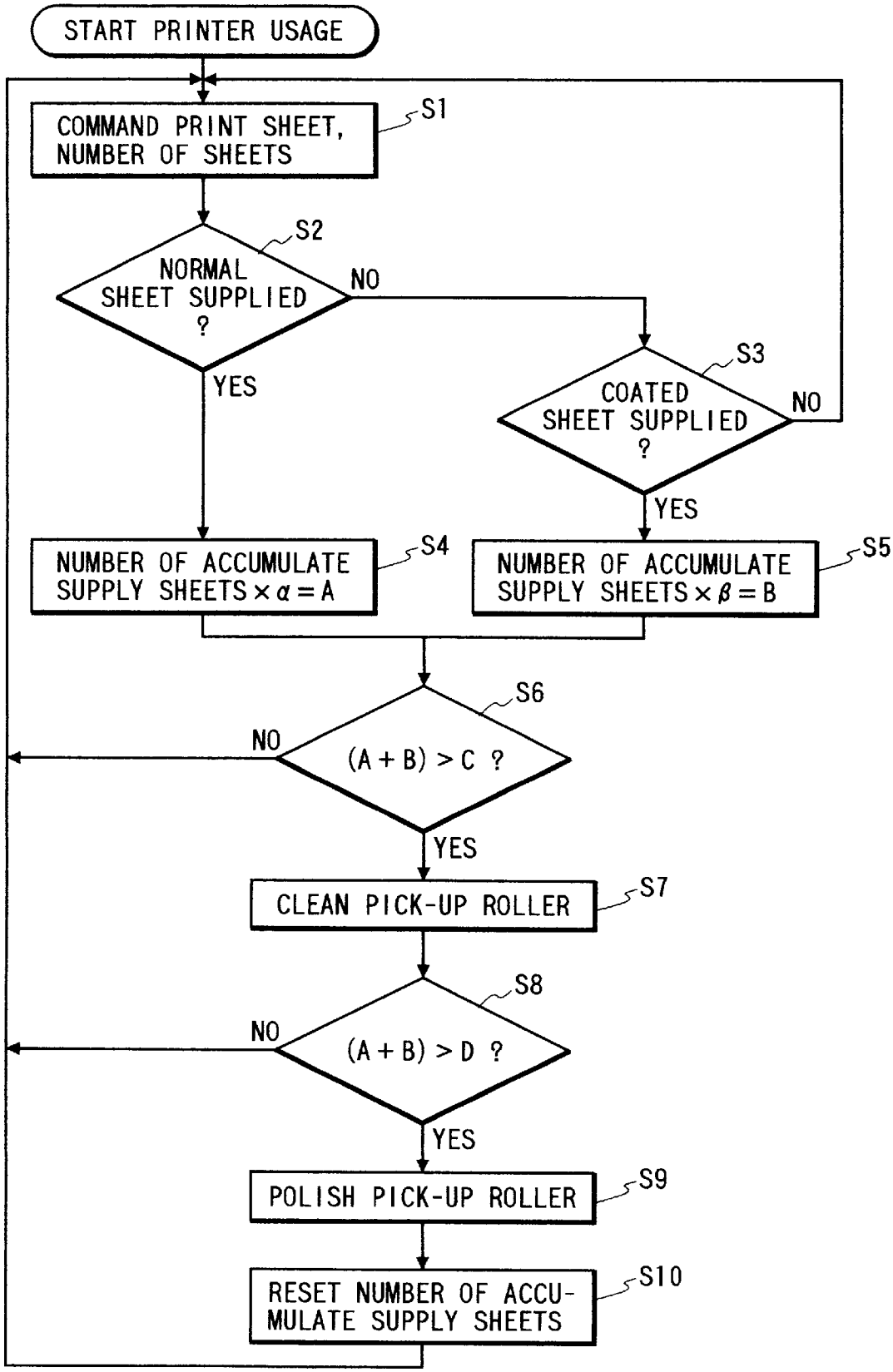
FIG. 2 is a flow chart showing an automatic operation of a recovery means.

The recovery operation can be effected automatically in accordance with the kind or number of sheets. To this end, for example, the control in a flow chart shown in FIG. 2 is effected by the control means. That is to say, for each kind of sheet designated in the image formation on the printer driver, the number of recorded sheets is accumulate-counted (step S1), and, in dependence with the kind of sheet to be supplied, the count numbers are accumulated in accordance with a predetermined coefficient (steps S2 to S5). For example, when the sheet to be supplied is a normal sheet, the coefficient a is set to 1 ($\alpha$=1), and, when the sheet to be supplied is an ink jet recording coated sheet, the coefficient $\beta$ is set to 2 ($\beta$=2). In this case, when 50 normal sheets were supplied in total and 40 coated sheets were supplied in total, A=50×1=50 and B=40×2=80. Thus, total value (A+B) becomes 130. The total value is compared with a predetermined cleaning reference value C (for example, C=100) (step S6). If the total value (A+B) exceeds the reference value C, the cleaning operation is effected automatically (step S7).

Further, the total value (A+B) is compared with a predetermined polishing reference value D (for example, D=300) (step S8). If the total value exceeds the reference value D, the polishing operation is performed (step S9). For example, at the time when 100 normal sheets were supplied in total and 50 coated sheets were supplied in total, since the total value (A+B) 100+100=200<D, the polishing operation is not effected. Whereas, at the time when 100 normal sheets were supplied in total and 101 coated sheets were supplied in total, since the total value (A+B)=100+202=302>D, the polishing operation is effected. After the polishing operation is performed, the numbers of accumulate supply sheets are reset (step S10).

Incidentally, the kinds of sheets are not limited to the normal sheet and the coated sheet, and, thus, the coefficients $\alpha$, $\beta$ are not limited to the above values but may be appropriately set. Further, the recovery operation can be manually performed by the operator periodically. For example, by using a lever and the like, the operator can slide the holder 10 to the left and right to oppose the cleaning pads 9*a* or the polishing pads 9*b* to the rubber roller portions of the pick-up roller 7, and then the pick-up roller 7 may be rotatingly driven. In this case, since the holder 10 is formed from the flat plate, the drive mechanism such as the pinion gear 11, rack 10*a* and the like can be omitted, so that the entire apparatus is made more compact.

In the illustrated embodiment, while an example that the pick-up roller 7 is lowered and lifted in accordance with the picking-up operation was explained, now, sheet supplying apparatuses in which a rotary shaft of a pick-up roller is not shifted (but rotatable) will be explained with reference to FIGS. 4A, 4B, 5A, 5B, 6A and 6B.

Figure 4A:
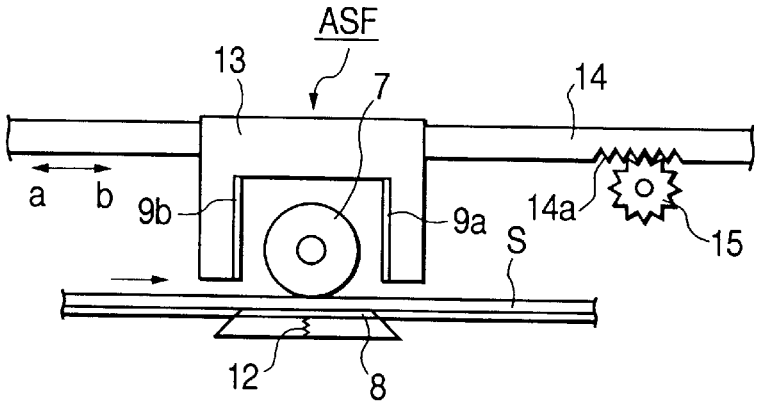
FIGS. 4A and 4B are explanatory views showing a main part of a sheet supplying apparatus according to another embodiment of the present invention in which a cleaning pad and a polishing pad are shifted in parallel.
Figure 4B:
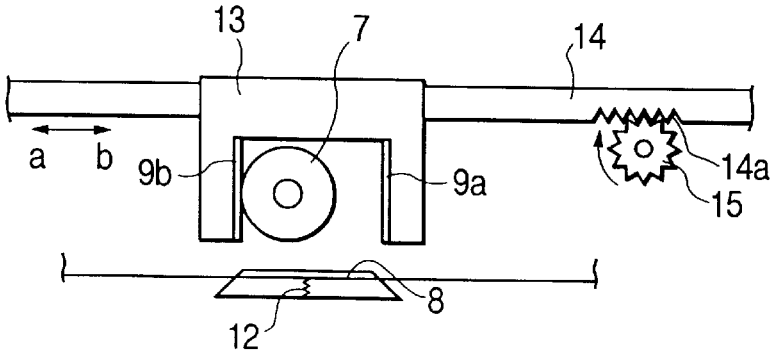

In a sheet supplying apparatus shown in FIGS. 4A and 4B, the separation pads 8 are biased upwardly by a spring 12 to urge the sheet S against the pick-up roller 7 as shown in FIG. 4A. Thus, when the sheet supplying operation is started, the pick-up roller 7 is rotated to cooperate with the separation pads 8 to thereby separate the sheets one by one from an uppermost sheet to be supplied toward directions a, b.

A recovery means 9 comprises an inverted U-shaped holder 13, a cleaning pad 9*a* attached to one of opposed side walls of the holder and a polishing pad 9*b* attached to the other side wall, and the holder 13 is secured to a rail 14. The rail 14 is provided with a rack 14*a* with which a pinion 15 is meshed. When the pinion 15 is rotated, the holder 13 is shifted together with the rail 14. In the sheet supply, as shown in FIG. 4A, the holder 13 is positioned so that both the cleaning pad 9*a* and the polishing pad 9*b* are not contacted with the pick-up roller 7. Thus, in this case, the pads 9*a*, 9*b* do not disturb the sheet supply of the pick-up roller 7.

In order to restore the sheet supplying force of the pick-up roller 7, for example, when the polishing operation is performed, as shown in FIG. 4B, the holder 13 is shifted in a direction b to urge the polishing pad 9*b* against the pick-up roller 7. In this condition, when the pick-up roller 7 is rotated, the surface of the pick-up roller 7 is polished. On the other hand, when the holder 13 is shifted in the direction a, the cleaning pad 9*a* is urged against the pick-up roller 7 to thereby permit the cleaning operation. In this way, the same advantage as the aforementioned embodiment can be achieved.

Figure 5A:
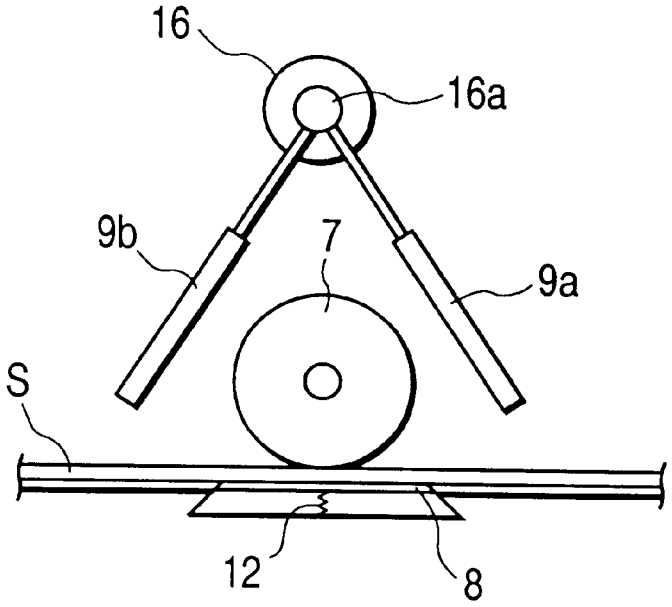
FIGS. 5A and 5B are explanatory views showing a main part of a sheet supplying apparatus according to a further embodiment of the present invention in which a cleaning pad and a polishing pad are rotatingly shifted.
Figure 5B:
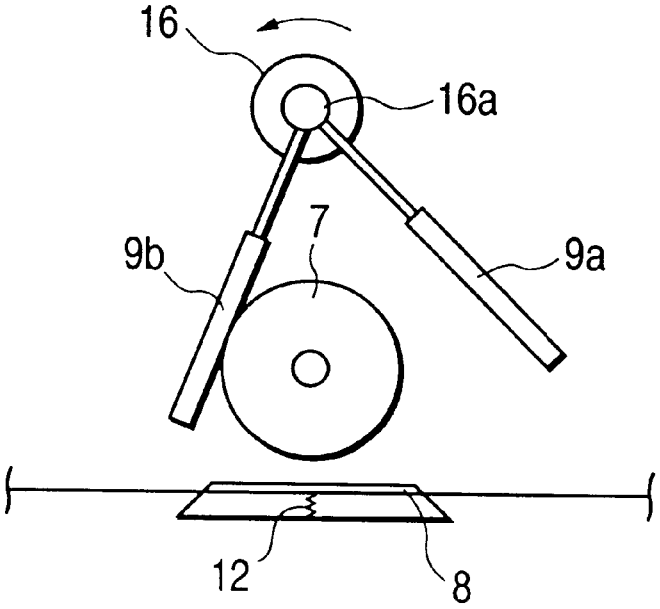

Incidentally, while an example that the cleaning pad 9*a* and the polishing pad 9*a* are shifted in parallel via the holder 13 was explained, the cleaning pad and the polishing pad may be rotated as shown in FIGS. 5A and 5B.

A recovery means shown in FIGS. 5A and 5B comprises a cleaning pad 9*a* and a polishing pad 9*b* both attached to a flange 16*a* of a motor 16. As shown in FIG. 5B, by rotating the motor 16, the cleaning pad 9*a* or the polishing pad 9*b* can be urged against the pick-up roller 7 to thereby permit the cleaning operation or the polishing operation.

Figure 6A:
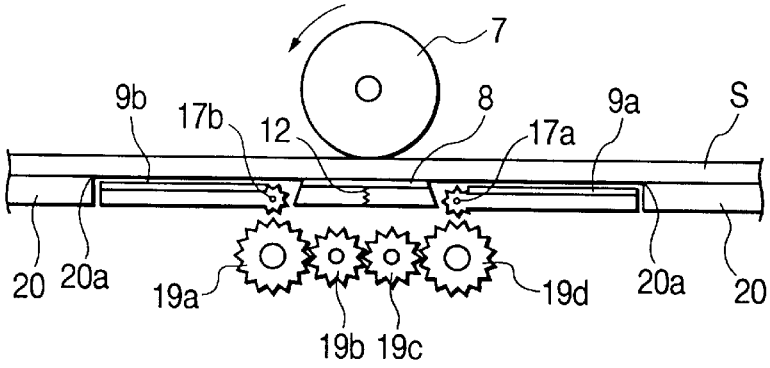
FIGS. 6A and 6B are explanatory views showing a main part of a sheet supplying apparatus according to a still further embodiment of the present invention in which a cleaning pad and a polishing pad can be contacted with a pick-up roller simultaneously.
Figure 6B:
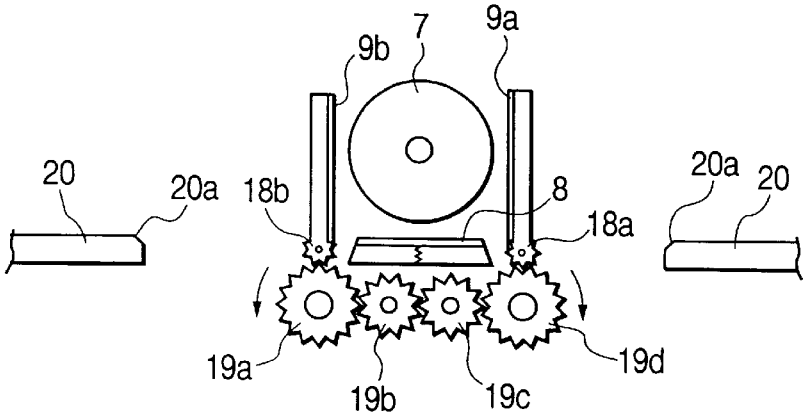

An arrangement as shown in FIGS. 6A and 6B provides similar operations. In a sheet supplying apparatus shown in FIGS. 6A and 6B, a cleaning pad 9*a* and a polishing pad 9*b* are supported on shafts 17*a* and 17*b*, respectively for rotational movements, and gears 18*a* and 18*b* are secured to the shafts 17*a* and 17*b*, respectively. The gear 18*a* is meshed with a gear 19*a* of a gear train 19*a* to 19*d* and the gear 18*b* is meshed with a gear 19*d* of the gear train. With this arrangement, when the gear train 19*a* to 19*d* is rotated, as shown in FIG. 6B, the cleaning pad 9*a* and the polishing pad 9*b* are rotated and cocked.

In the above arrangement, when the sheet S is supplied by the pick-up roller 7, as shown in FIG. 6A, the cleaning pad 9*a* and the polishing pad 9*b* are positioned below the sheet S to be retracted below guide plates 20. Thus, the pads do not disturb the sheet supply. Further, end faces 20*a* of the guide plates 20 are chamfered not to disturb the sheet supply. Thus, the end of the sheet S is hard to be entered between the guide plate 20 and the cleaning pad 9*a* and between the guide plate 20 and the polishing pad 9*b*. In this sheet supplying apparatus, if the sheet supplying force of the pick-up roller 7 is reduced, the sheet supplying force can be restored or recovered by operating the recovery means. In this recovery means, when the gear train 19*a* to 19*d* are rotated, as shown in FIG. 6B, the cleaning pad 9*a* and the polishing pads 9*b* are cocked to be urged against the pick-up roller 7. In this condition, when the pick-up roller 7 is rotated, the cleaning operation and the polishing operation are performed simultaneously.

In the embodiment shown in FIGS. 6A and 6B, while an example that the cleaning pad 9*a* and the polishing pad 9*b* are simultaneously cocked by the gear train 19*a* to 19*d* was explained, the cleaning pad and the polishing pad may be cocked by independent drive sources. In this case, the cleaning operation and the polishing operation can be performed independently.

Also in this embodiment, as is in the aforementioned embodiment, the recovering operation of the pick-up roller 7 can be automatically effected in accordance with the kind and number of sheets.

Figure 7:
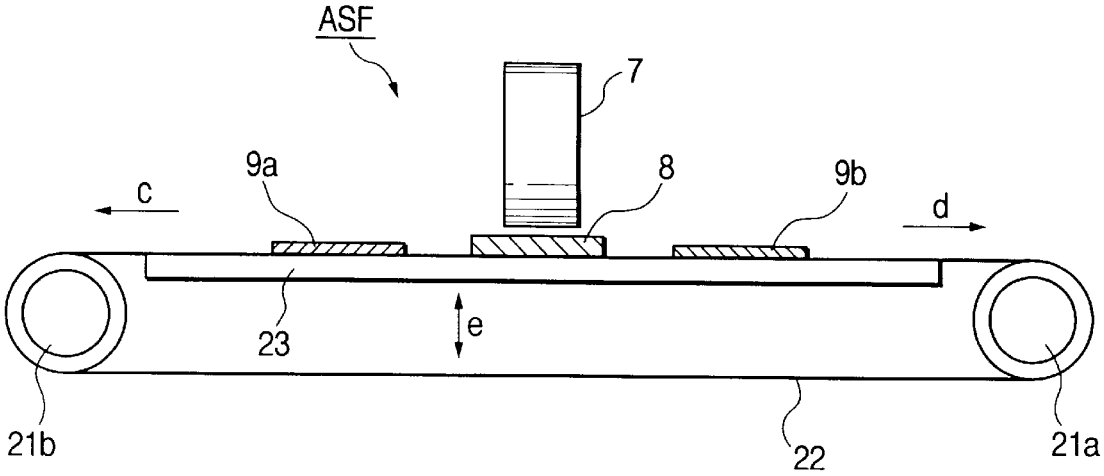
FIG. 7 is a schematic explanatory view of a recovery means according to another embodiment, looked at from a sheet supplying direction.

Next, a further example of a recovery means will be described with reference to FIGS. 7, 8A and 8B. In a sheet supplying apparatus ASF according to this embodiment, as shown in FIG. 7, a separation pad 8, a cleaning pad 9*a* and a polishing pad 9*b* are attached onto a belt 22 mounted around a drive pulley 21*a* and a driven pulley 21*b* to be rotated in directions c, d (perpendicular to a sheet supplying direction). Further, a pressure plate 23 for urging the pads 8, 9*a* and 9*b* against the pick-up roller 7 via the belt 22 is provided for movement in directions e.

Figure 8A:
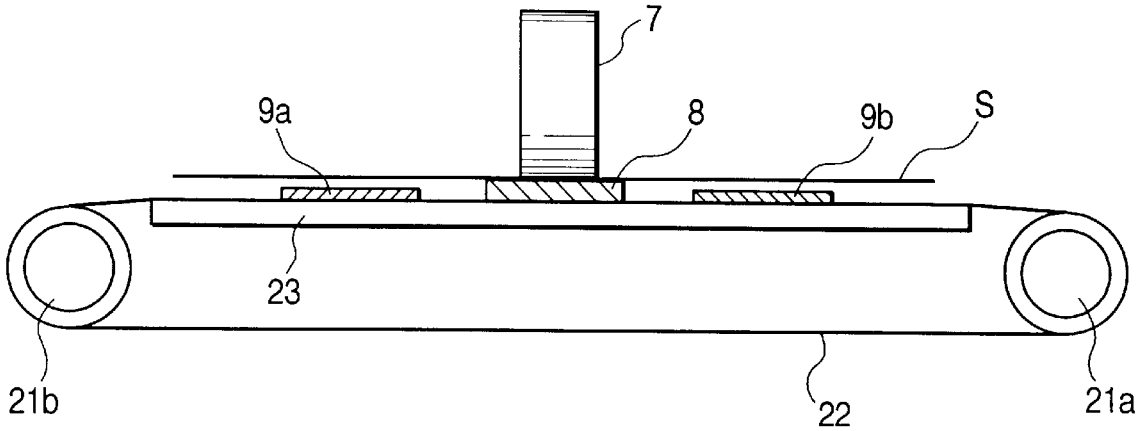
FIGS. 8A and 8B are explanatory views showing a sheet supplying condition and an operation of the recovery means.

With this arrangement, when the sheet S is supplied, as shown in FIG. 8A, the separation pad 8 is opposed to the pick-up roller 7 and is urged against the pick-up roller by lifting the pressure plate 23. In this condition, when the recording operation is started, by the cooperation between the pick-up roller 7 and the separation pad 8, the sheets S are separated one by one from an uppermost sheet.

Figure 8B:
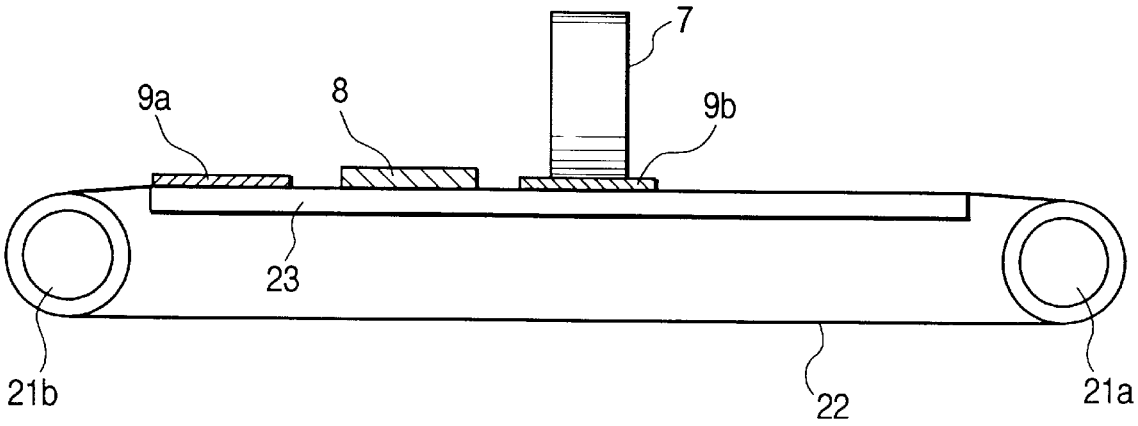

When it is desired to restore the sheet supplying force of the pick-up roller 7 by the polishing operation, as shown in FIG. 8B, the belt 22 is rotated to oppose the polishing pad 9*b* to the pick-up roller 7, and then, the polishing pad 9*b* is urged against the pick-up roller 7 by lifting the pressure plate 23. In this condition, when the pick-up roller 7 is rotated, the surface of the roller 7 is polished. Incidentally, when the cleaning operation is performed, the belt 22 is rotated to oppose the cleaning pad 9*a* to the pick-up roller 7 and the cleaning pad is urged against the pick-up roller by lifting the pressure plate.

Since the belt 22 is rotated in the direction perpendicular to the sheet supplying direction, when the pad 8, 9*a* or 9*b* is urged against the pick-up roller 7, the pad is not displaced in the rotational direction of the belt due to the rotation of the pick-up roller 7. The sheet supplying force of the pick-up roller 7 can be restored by scraping the surface of the pick-up roller 7 or removing the paper powder and other foreign matters from the pick-up roller.

Figure 9A:
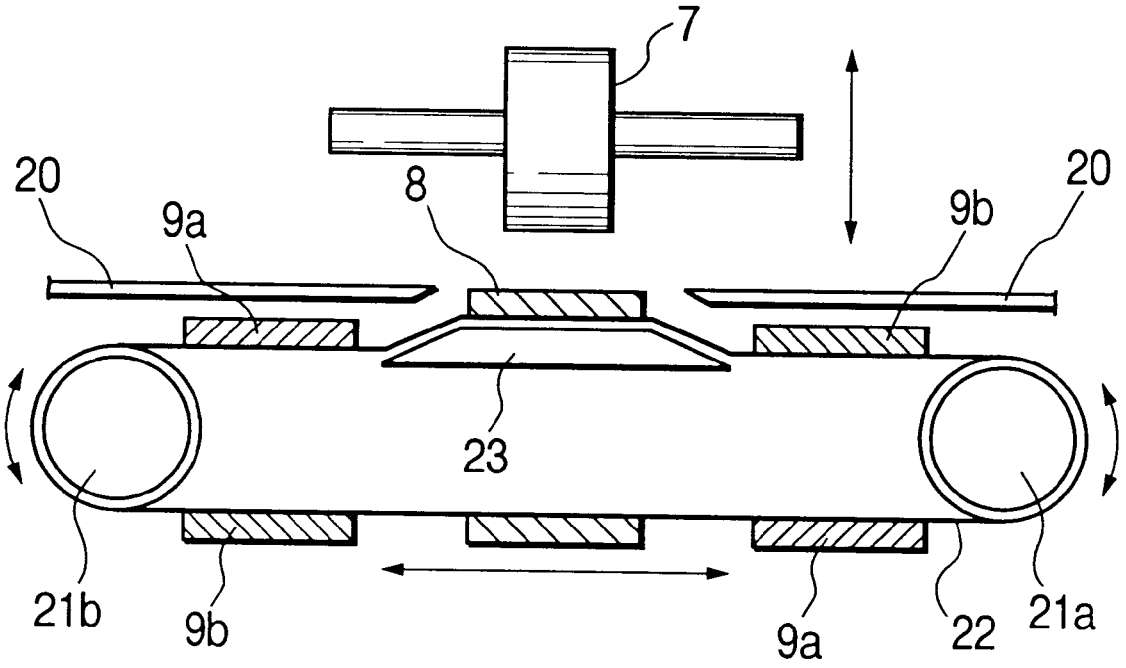
FIGS. 9A and 9B are views of a recovery means, looked at from a sheet supplying direction, where
Figure 9B:
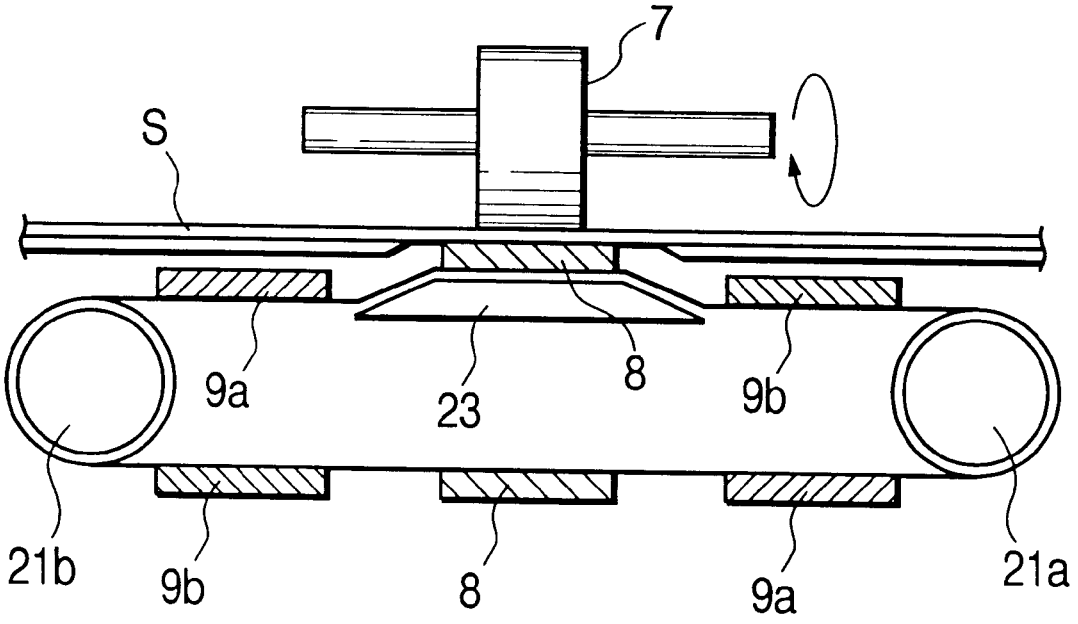
Figure 10A:
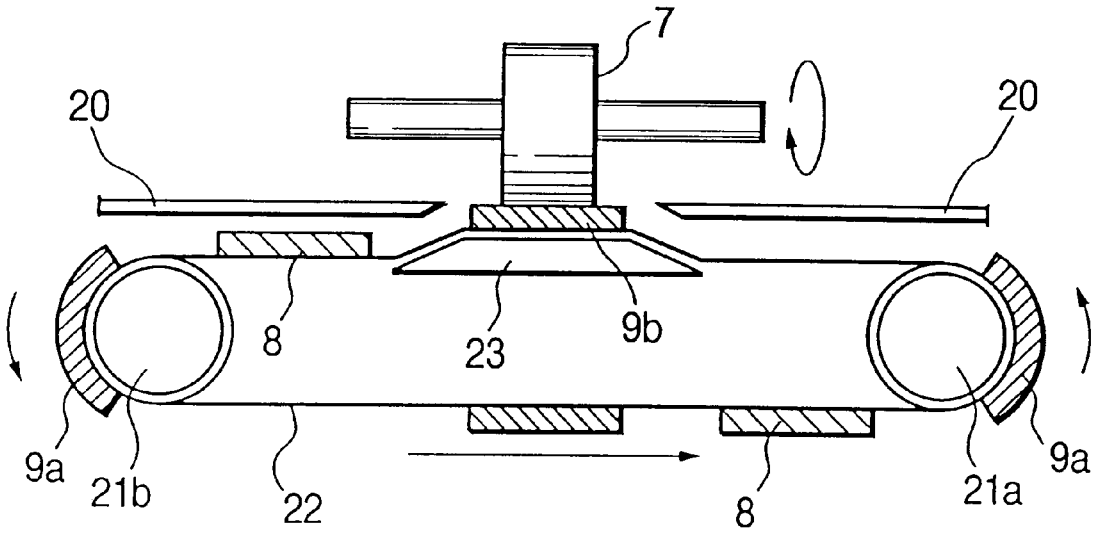
FIGS. 10A and 10B are views showing an operation of the recovery means, where
Figure 10B:
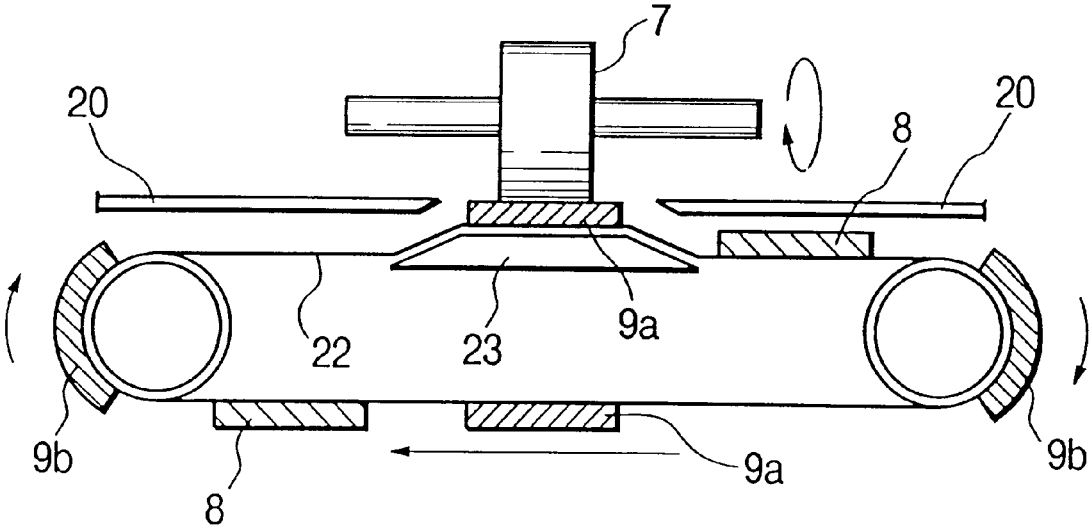
Figure 11A:
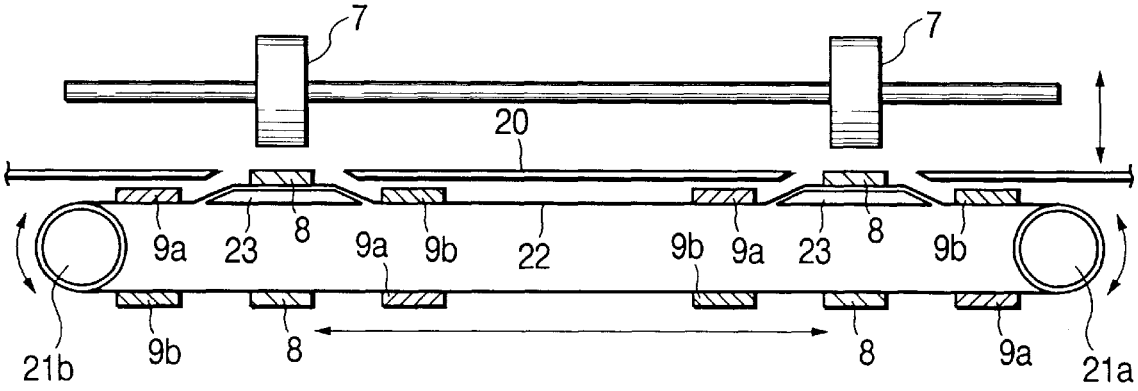
FIGS. 11A and 11B are views of a recovery means of a sheet supplying apparatus having two pick-up rollers, looked at from a sheet supplying direction, where
Figure 11B:
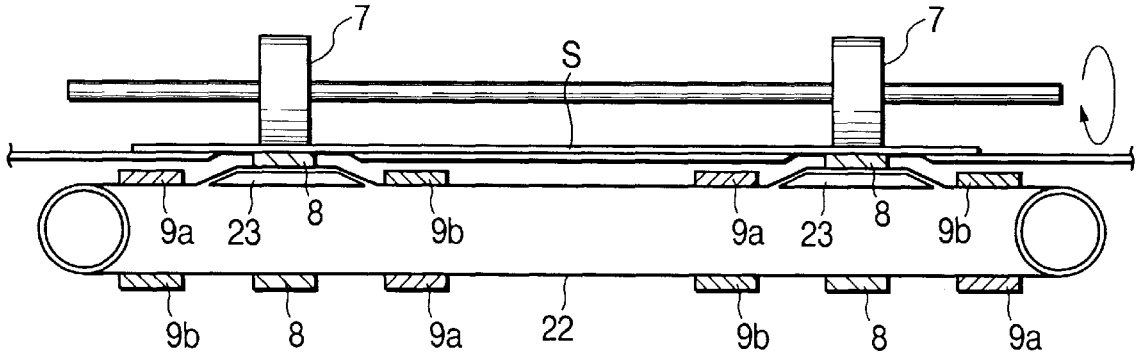
Figure 12A:
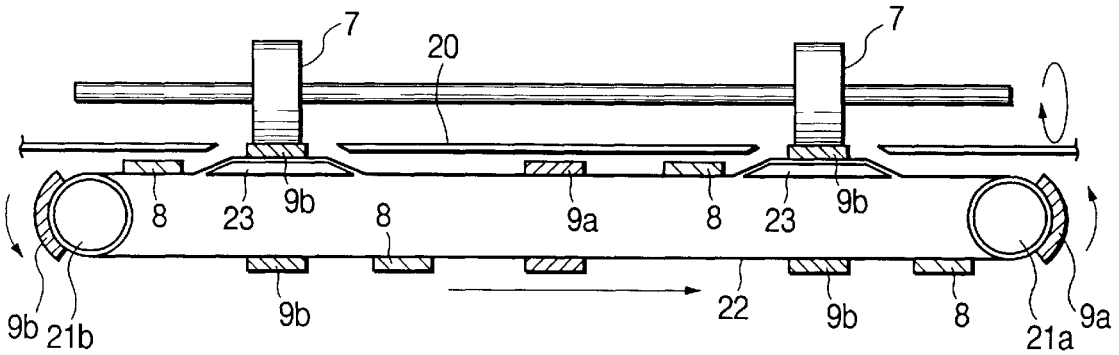
FIGS. 12A and 12B are views showing an operation of the recovery means, where
Figure 12B:
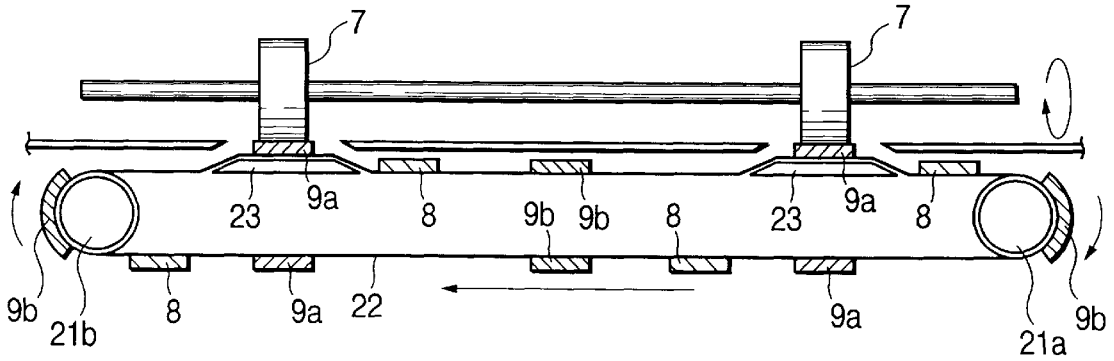
Figure 13A:
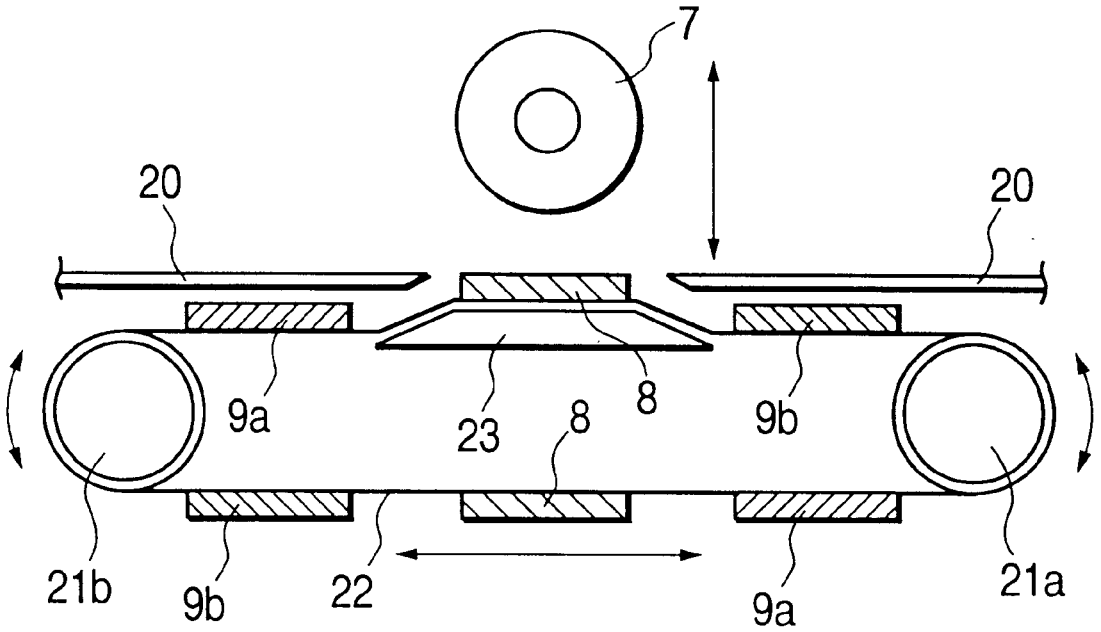
FIGS. 13A and 13B are views of the recovery means of the sheet supplying apparatus, looked at from a direction perpendicular to the sheet supplying direction, where
Figure 13B:
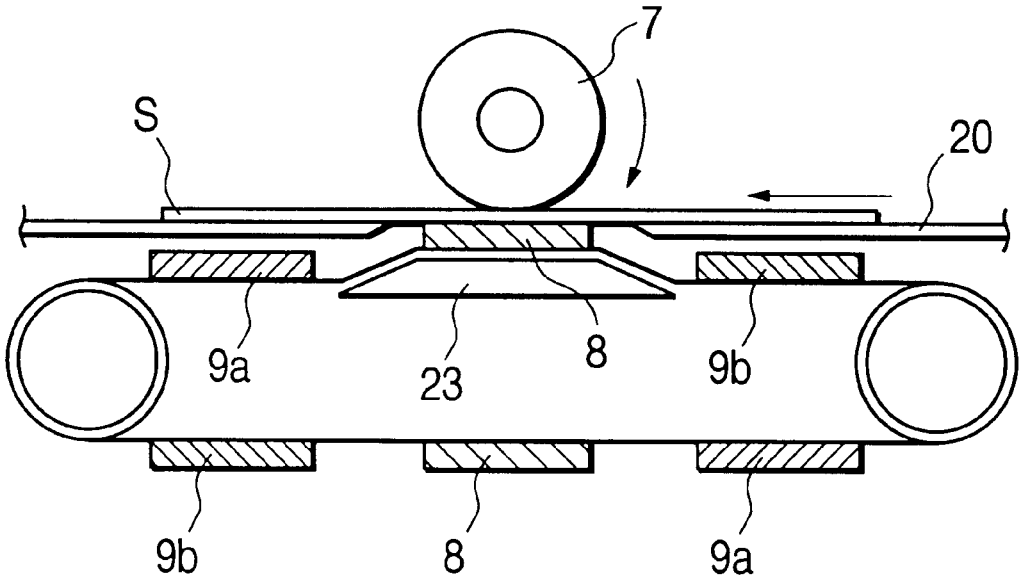
Figure 14A:
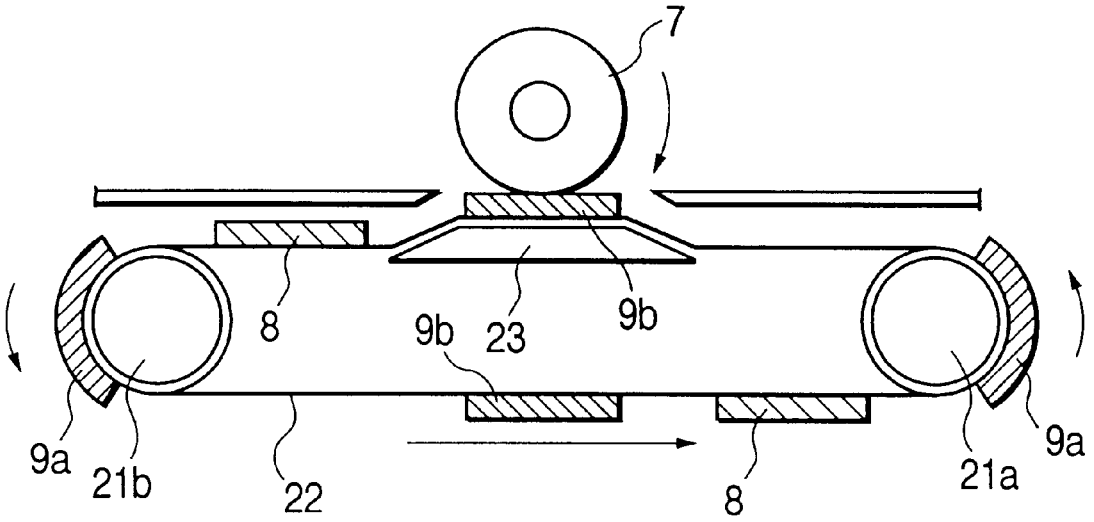
FIGS. 14A and 14B are views showing an operation of the recovery means, where
Figure 14B:
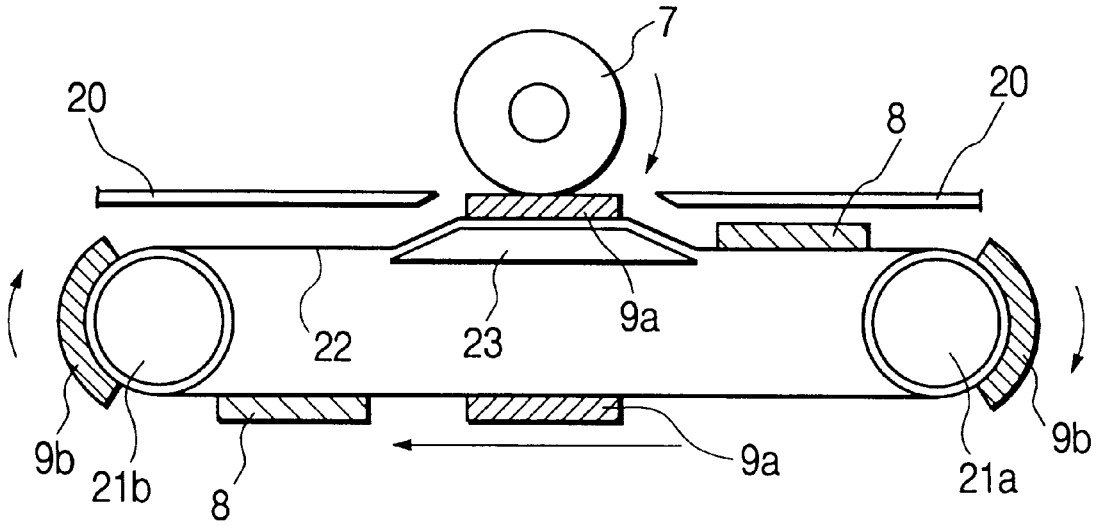

A still further example of a recovery means will be described with reference to FIGS. 9A, 9B, 10A, 10B, 11A, 11B, 12A, 12B, 13A, 13B, 14A and 14B. In a sheet supplying apparatus ASF according to this embodiment, as shown in FIGS. 9A and 9B, similar to the abovementioned embodiment, cleaning pads 9*a* and the like are shifted by a belt 22. Unlike to the embodiment shown in FIGS. 7, 8A and 8B, two separation pads 8, two cleaning pads 9*a* and two polishing pads 9*b* are attached to the belt 22. FIGS. 9A and 9B are views of a recovery means, looked at from a sheet supplying direction, where FIG. 9A shows a schematic construction and FIG. 9B shows a sheet supplying condition. FIGS. 10A and 10B are views showing an operation of the recovery means, where FIG. 10A shows a polishing operation and FIG. 10B shows a cleaning operation.

By providing two pads 8, 9*a*, 9*b*, respectively, if one of two pads 8, 9*a* or 9*b* is worn, by using the other pad, the pad itself can be refreshed. Further, by using two pads 8, 9*a* or 9*b* alternately, the entire service life of each pad can be increased.

Further, when a shifting amount of each cleaning pad 9*a* and each polishing pad 9*b* with respect to the pick-up roller 7 is adjustable, by shifting the pad 9*a* or 9*b* in one direction or reciprocally shifting the pad by a predetermined amount, only a desired portion of the pick-up roller 7 can be cleaned or polished. In this case, by setting so that the section of the cleaning pad 9*a* and the polishing pad 9*b* in a direction perpendicular to the shifting direction of the pad is aligned with the section of the pick-up roller 7, the cleaning efficiency and polishing efficiency can be improved.

Incidentally, as shown in FIGS. 11A, 11B, 12A and 12B, when two pick-up rollers 7 are provided on the same rotary shaft, the picking-up operation can be performed more positively. Also in this case, two cleaning pads 9*a* and two polishing pads 9*b* may be associated with each pick-up roller 7.

While an example that the belt 22 for shifting the recovery means is rotated in the direction perpendicular to the sheet supplying direction was explained, as shown in FIGS. 13A, 13B, 14A and 14B, even when the belt 22 is rotated in a direction parallel with the sheet supplying direction, similar advantage can be obtained.

Figure 15:
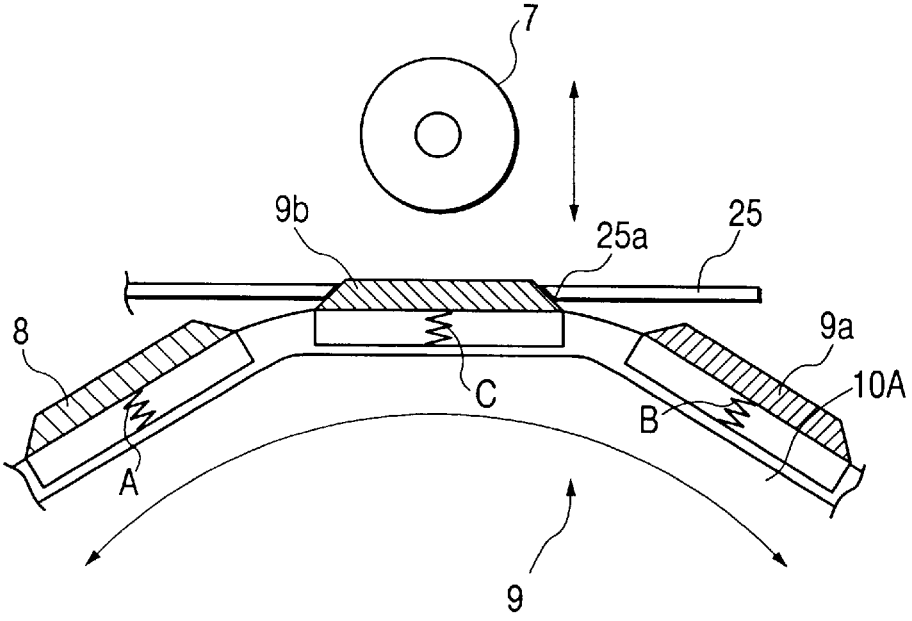
FIG. 15 is an enlarged view of a main part of a sheet supplying apparatus according to a further embodiment of the present invention.

FIGS. 15 to 18 are explanatory views (enlarged views of a pick-up roller and a separation pad 8) for explaining an operation of a friction separation means. As shown in FIG. 15, a pick-up roller 7 is supported for up-and-down movement, and a separation pad 8, a polishing pad (polishing means) 9*b* and a cleaning pad (cleaning means) 9*a* are attached, via springs (biasing means) A, B and C, to a polygonal holder 10A rotated by a drive source such as a motor. The polishing pad and the cleaning pad constitute a recovery means 9 for the pick-up roller 7.

Sheets S are rested on a plate 25 having an opening 25*a* through which the pad 8, 9*a* or 9*b* can be exposed to the pick-up roller 7. When the pad 8, 9*a* or 9*b* is aligned with the opening 25*a* by rotating the holder 10A, the pad are biased by the spring A, B or C to be protruded from the plate 25 toward the pick-up roller 7 through the opening 25*a*.

Figure 16:
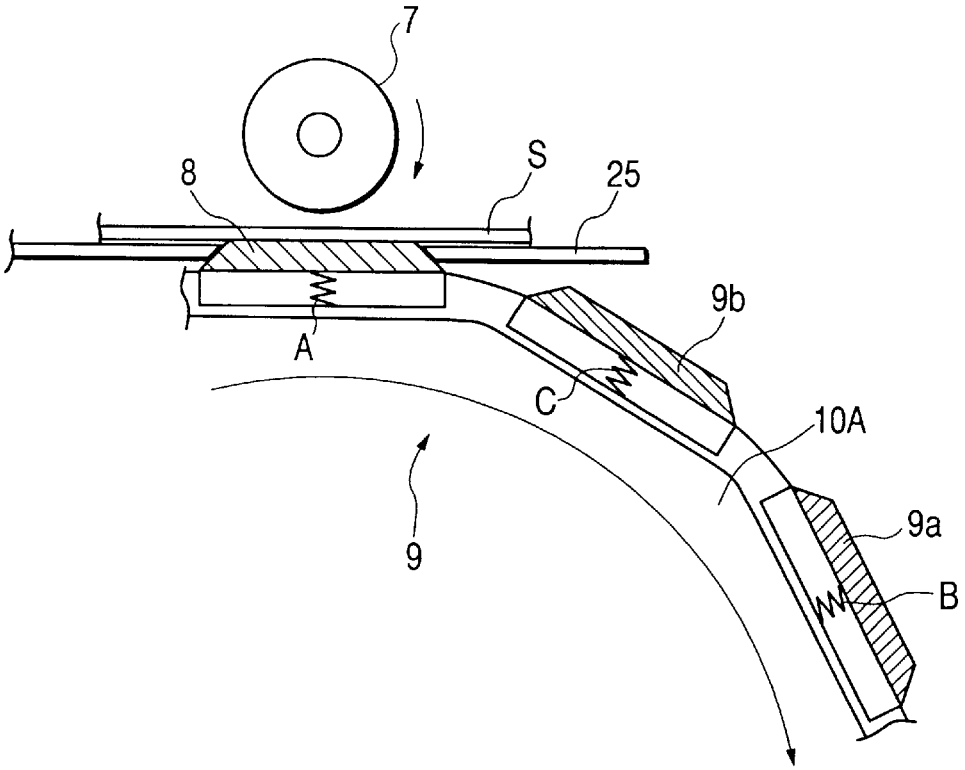
FIGS. 16, 17 and 18 are explanatory views showing an operation of the apparatus of FIG. 15.

FIG. 16 shows a normal condition that the sheet is supplied. In this condition, the separation pad 8 is exposed through the opening 25*a* to be opposed to the pick-up roller 7. When the pick-up roller 7 is rotated in a direction shown by the arrow, only an uppermost sheet among the sheets S stacked on the plate 25 is supplied. If the other sheets try to move together with the uppermost sheet, the other sheets cannot be advanced by the friction force of the separation pad 8.

Figure 17:
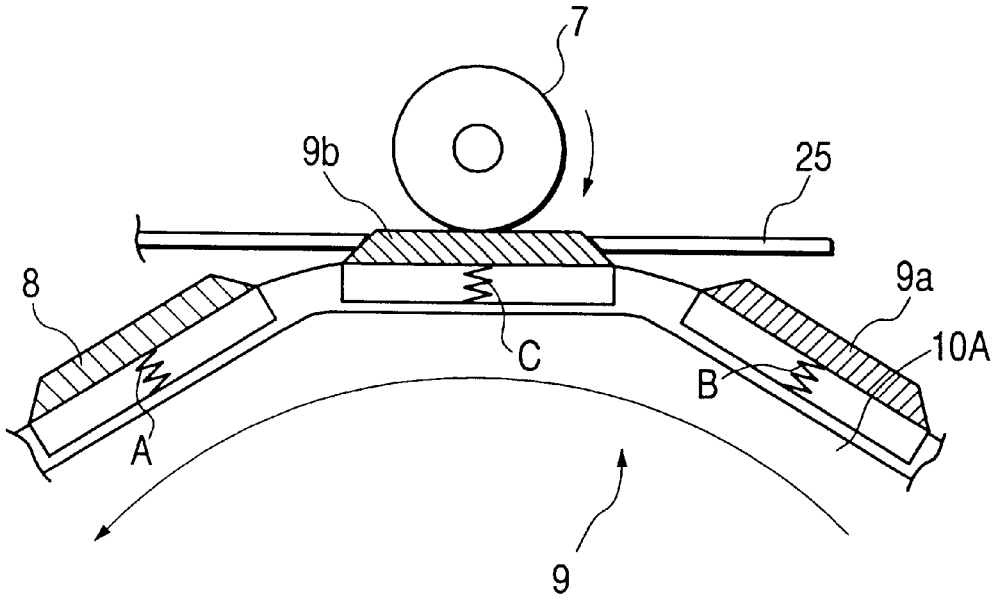

FIG. 17 shows a condition that the polishing pad 9*b* is exposed through the opening 25*a* (after rotation of the holder 10A) and is urged against the pick-up roller 7 by the spring C. In this condition, when the pick-up roller 7 is rotated, the surface of the pick-up roller 7 is polished (scraped) to thereby restore the friction force of the roller.

Figure 18:
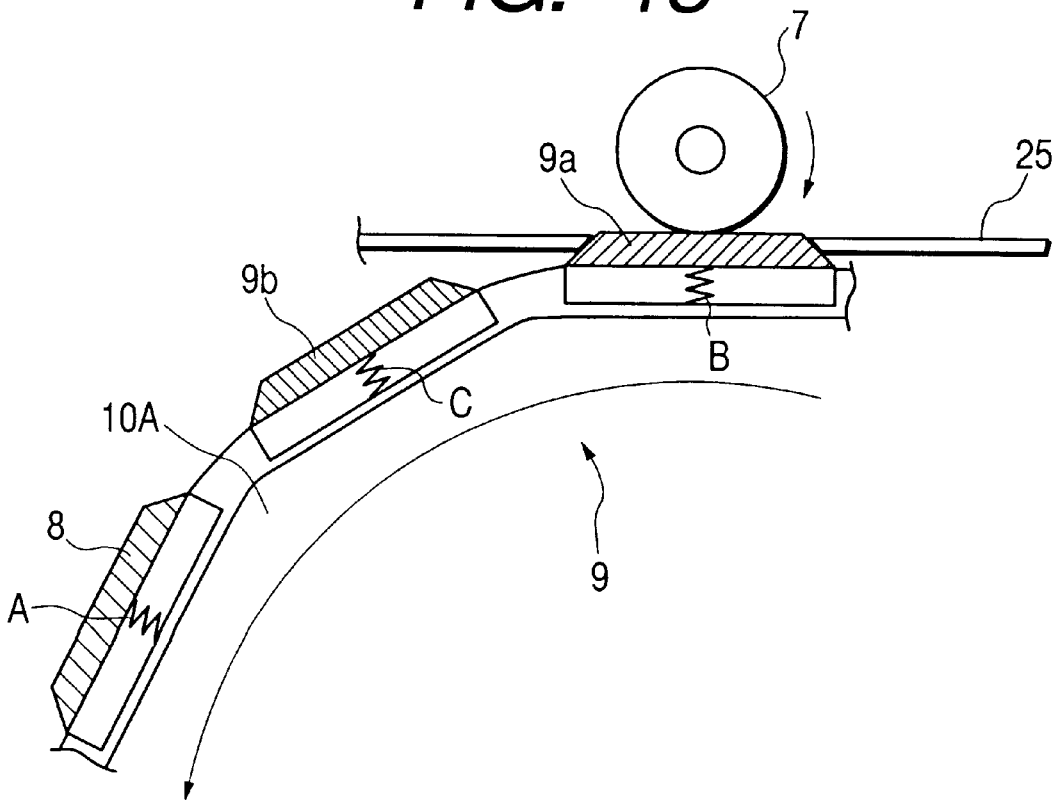

FIG. 18 shows a condition that the cleaning pad 9*a* is exposed through the opening 25*a* (after rotation of the holder 10A) and is urged against the pick-up roller 7 by the spring B. In this condition, when the pick-up roller 7 is rotated, foreign matters adhered to the surface of the pick-up roller 7 is cleaned (removed), thereby restoring the friction force of the roller. Incidentally, after the polishing operation, when the cleaning operation is performed by the cleaning pad 9*a*, chips generated by the polishing operation can also be removed.

The sheet supplying operation is normally performed in the condition shown in FIG. 16, and, by rotating the holder 10A periodically to bring the apparatus to the condition shown in FIG. 17 or 18, the polishing operation or the cleaning operation can be effected. Thus, since the friction force of the pick-up roller 7 can be maintained in a good condition, the proper sheet supply can always be performed.

The holder 10A may be rotated by periodically depressing a switch (or a roller refresh button) (by the operator) or may be automatically rotated at predetermined frequency in accordance with the kind and number of sheets. Alternatively, a detection device for detecting the surface condition of the pick-up roller or a detection device for detecting a sheet supplying speed is provided, and the holder may be rotated when it is judged that the polishing operation and/or cleaning operation should be performed by the detection device.

FIGS. 19 to 22 show embodiments in which a cylindrical holder is used.

Figure 19:
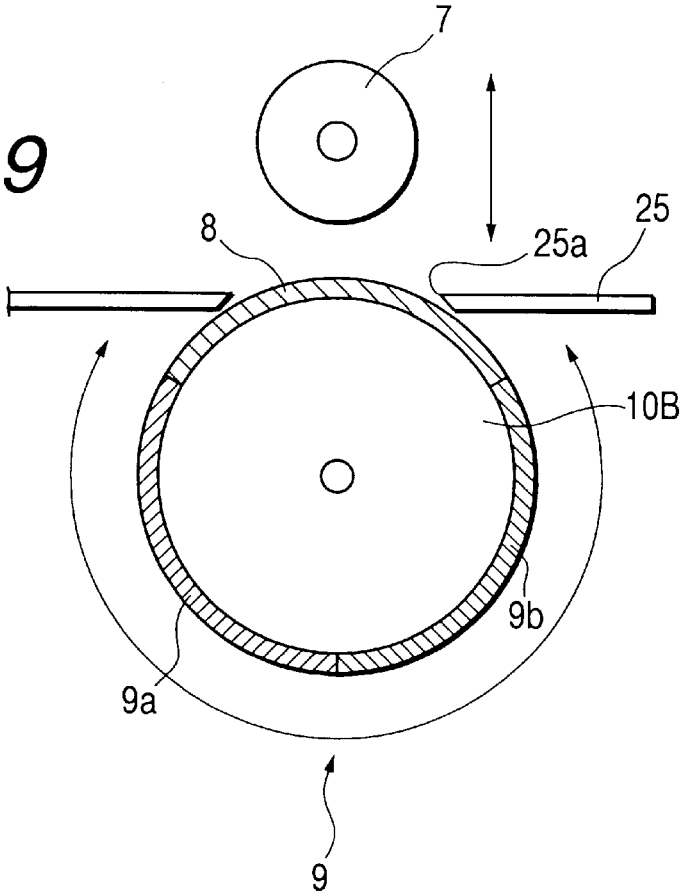
FIG. 19 is an enlarged view of a main part of a sheet supplying apparatus according to a still further embodiment of the present invention.

FIG. 19 is an enlarged view of a pick-up roller 7 and a holder 10B. A separation pad 8, a polishing pad 9*b* and a cleaning pad 9*a* are provided on a cylindrical surface of the holder 10B so that the pad can be exposed through an opening 25*a* of a plate 25 without utilizing any springs.

Figure 20:
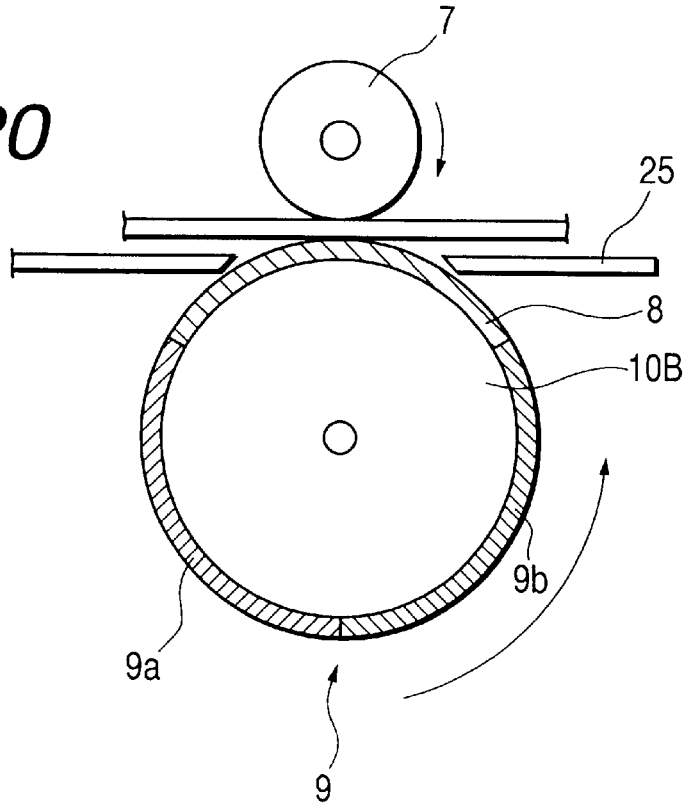
FIGS. 20, 21 and 22 are explanatory views showing an operation of the apparatus of FIG. 19.
Figure 21:
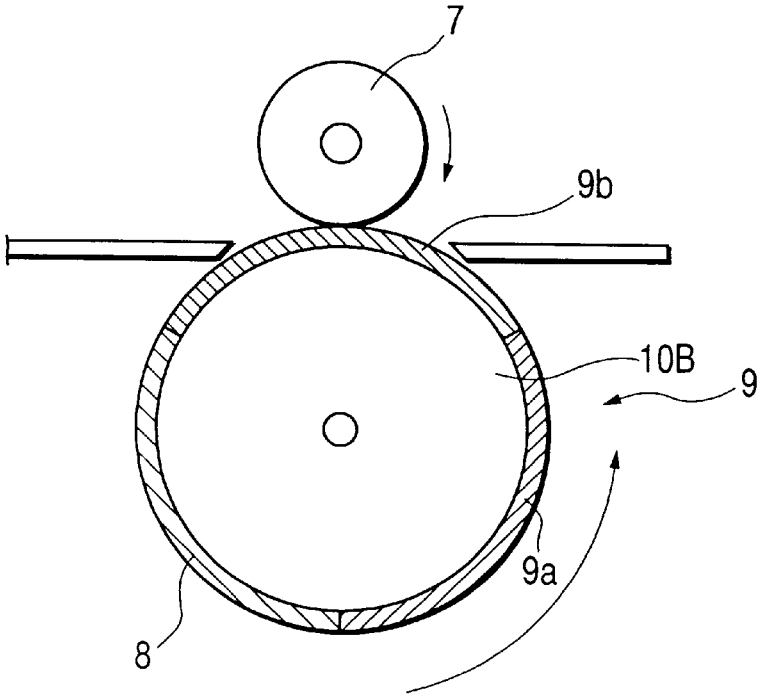
Figure 22:
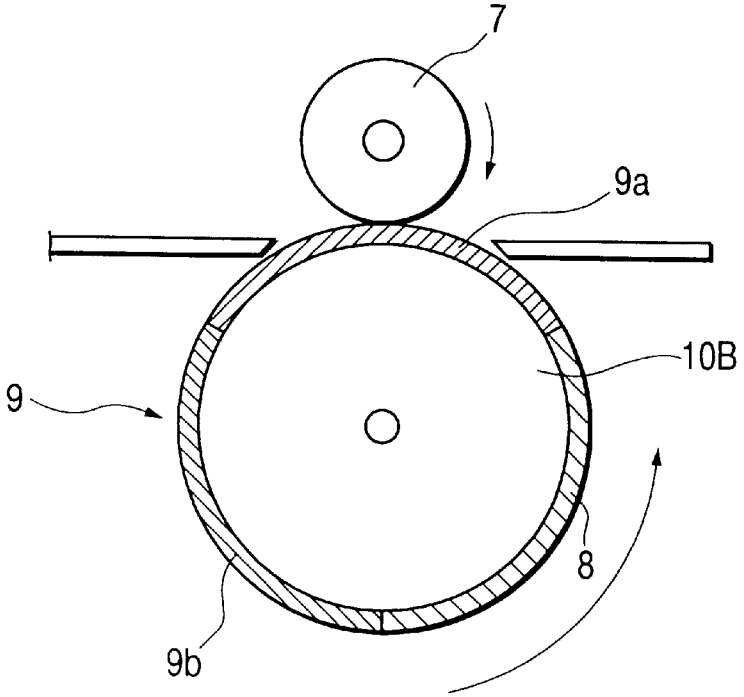

FIG. 20 shows a normal condition that the sheet is supplied. In this condition, the separation pad 8 is exposed and protruded through the opening 25*a*. FIG. 21 shows a condition that the polishing operation is performed. In this condition, the polishing pad 9*b* is exposed and protruded through the opening 25*a*. FIG. 22 shows a condition that the cleaning operation is performed. In this condition, the cleaning pad 9*a* is exposed and protruded through the opening 25*a*.

Figure 23:
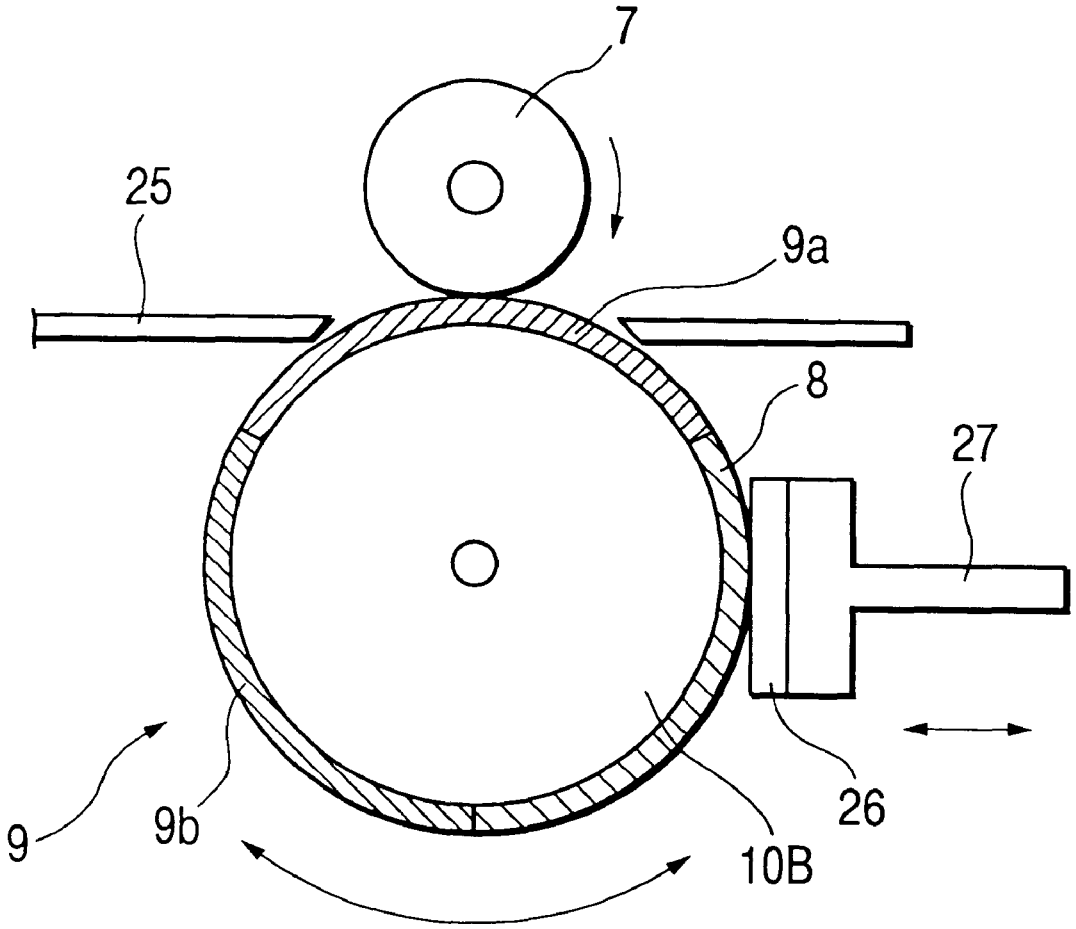
FIG. 23 is an explanatory view showing an operation of a main part of a sheet supplying apparatus according to the other embodiment of the present invention.

FIG. 23 shows an embodiment in which a polish means for polishing the surface of the separation pad 8 is provided.

As shown in FIG. 23, a polish holder 27 provided at its surface with a polish pad 26 is supported for movement toward and away from the separation pad 8. In a condition that the polish pad 26 is urged against the separation pad 8, when the holder 10B is rotated, the surface of the separation pad 8 is polished, the friction force of the separation pad 8 is maintained in a good condition, so that the sheet separating ability is improved.

In the above-mentioned embodiments, while an example that the sheet supplying apparatus is used with the ink jet printer was explained, the image forming means is not limited to the ink jet recording means, and the present invention can be applied to other image forming apparatuses of electrophotographic type, heat transfer recording type and the like.

Further, in place of the image forming means, an image reading means may be used. That is to say, the sheet supplying apparatus ASF may be used with an image reading apparatus in which originals are separated and supplied one by one and image information on the supplied original is read by the image reading means.

What is claimed is:

1. A sheet supplying apparatus, comprising:

a main frame;

sheet supporting means provided within said main frame for supporting a sheet;

sheet supply rotary means for feeding out the sheet supported by said sheet supporting means;

recovery means for recovering a sheet supplying force of said sheet supply rotary means; and switching means for shifting said recovery means between a recovery position abutting against said sheet supply rotary means to effect a recovery operation, and a waiting position being spaced apart from said sheet supply rotary means.

2. A sheet supplying apparatus according to claim 1, wherein said recovery means includes a cleaning means for cleaning a surface of said sheet supply rotary means and a polishing means for polishing the surface of said sheet supply rotary means, and said switching means shifts said recovery means from the waiting position to the recovery position and selectively switches said cleaning means and said polishing means to be urged against said sheet supply rotary means.

3. A sheet supplying apparatus according to claim 2, wherein said switching means is a rotary member rotatably supported to which said cleaning means and said polishing means are attached so that, by rotating said rotary member, said cleaning means and said polishing means are selectively shifted to a position to be urged against said sheet supply rotary means.

4. A sheet supplying apparatus according to claim 3, wherein said rotary member is an endless belt.

5. A sheet supplying apparatus according to claim 3, wherein said rotary member is a holder rotatably supported.

6. A sheet supplying apparatus according to one of claims 3 to 5, further comprising a drive means for rotating said rotary member, and a control means for automatically shifting said cleaning means or said polishing means to the position to be urged against said sheet supply rotary means.

7. A sheet supplying apparatus according to claim 2, wherein said switching means has a support member which can be translated in parallel to which said cleaning means and said polishing means are attached so that, when said support member is translated in parallel, said cleaning means and said polishing means are selectively shifted to a position to be urged against said sheet supply rotary means.

8. A sheet supplying apparatus according to claim 7, wherein said support member is provided with a rack portion with which a pinion gear provided on a main body of said apparatus is engaged so that said support member is shifted by rotating said pinion gear by a drive means, and further comprising a control means for controlling said drive means to automatically shift said cleaning means or said polishing means to the position to be urged against said sheet supply rotary means.

9. A sheet supplying apparatus according to claim 1 or 2, further comprising a drive means for automatically switching said switching means, and a control means for controlling said drive means.

10. A sheet supplying apparatus according to claim 9, wherein said control means controls said drive means so that it is operated in accordance with a feed amount of the sheet fed out by said sheet supply rotary means.

11. A sheet supplying apparatus according to claim 2, further comprising a second polishing means for polishing said polishing means, said second polishing means abutting against said polishing means when said polishing means is in the waiting position.

12. A sheet supplying apparatus according to claim 1, wherein said recovery means includes a cleaning means for cleaning a surface of said sheet supply rotary means and a polishing means for polishing the surface of said sheet supply rotary means, and said switching means causes to engage or disengage said cleaning means and said polishing means with respect to said sheet supply rotary means simultaneously.

13. A sheet supplying apparatus, comprising:

a main frame;

sheet supporting means provided within said main frame for supporting sheets;

sheet supply rotary means for feeding out the sheet supported by said sheet supporting means;

a friction member disposed on said sheet supporting means at a position confronting to said sheet supply rotary means and contacted with a lowermost sheet among the sheets supported by said sheet supporting means;

recovery means for recovering a sheet supplying force of said sheet supply rotary means; and switching means for selectively shifting said friction member or said recovery means to a position confronting to said sheet supply rotary means.

14. A sheet supplying apparatus according to claim 13, wherein said recovery means includes a cleaning means for cleaning a surface of said sheet supply rotary means and a polishing means for polishing the surface of said sheet supply rotary means, and said switching means selectively causes said friction member, said cleaning means or said polishing means to abut against said sheet supply rotary means.

15. A sheet supplying apparatus according to claim 14, wherein said switching means has a support member to which said friction member, said cleaning means and said polishing means are attached.

16. A sheet supplying apparatus according to claim 13, further comprising a drive means for automatically switching said switching means, and a control means for controlling said drive means.

17. A sheet supplying apparatus according to claim 16, wherein said control means controls said drive means so that it is operated in accordance with a feed amount of the sheet fed out by said sheet supply rotary means.

18. An image forming apparatus comprising:

a main frame;

sheet supporting means provided within said main frame for supporting a sheet;

sheet supply rotary means for feeding out the sheet supported by said sheet supporting means;

image forming means for forming an image on the sheet fed out by said sheet supply rotary means;

recovery means attached to the main frame for recovering a sheet supplying force of said sheet supply rotary means; and switching means for shifting said recovery means between a recovery position abutting against said sheet supply rotary means to effect a recovery operation, and a waiting position being spaced apart from said sheet supply rotary means.

19. An image forming apparatus according to claim 18, wherein said image forming means is of ink jet type in which ink is discharged toward the sheet to form the image.

20. An image forming apparatus comprising:

a main frame;

a sheet supporting means provided within said main frame for supporting sheets;

a sheet supply rotary means for feeding out the sheet supported by said sheet supporting means;

an image forming means for forming an image on the sheet fed out by said sheet supply rotary means;

a friction member disposed on said sheet supporting means at a position confronting to said sheet supply rotary means and contacted with a lowermost sheet among the sheets supported by said sheet supporting means;

a recovery means for recovering a sheet supplying force of said sheet supply rotary means; and a switching means for selectively shifting said friction member or said recovery means to a position confronting to said sheet supply rotary means.

21. An image forming apparatus according to claim 20, wherein said image forming means is of ink jet type in which ink is discharged toward the sheet to form the image.

* * * * *

UNITED STATES PATENT AND TRADEMARK OFFICE

CERTIFICATE OF CORRECTION

PATENT NO. : 6,042,104

DATED : March 28, 2000

INVENTOR(S): TOSHIHIKO NISHIKORI, ET AL.

It is certified that error appears in the above-identified patent and that said Letters Patent is hereby corrected as shown below:

COLUMN 4:
Line 48, "ruller" should read --roller--.

COLUMN 5:
Line 11, "are" should read --is--; and
Line 54, "a" should read --α--.

COLUMN 6:
Line 3, "(A+B) 100" should read --(A+B)=100--.

COLUMN 8:
Line 14, "to" should be deleted; and
Line 63, "are" should read --is--.

UNITED STATES PATENT AND TRADEMARK OFFICE

CERTIFICATE OF CORRECTION

PATENT NO. : 6,042,104

DATED : March 28, 2000

INVENTOR(S): TOSHIHIKO NISHIKORI, ET AL. Page 2 of 2

It is certified that error appears in the above-identified patent and that said Letters Patent is hereby corrected as shown below:

COLUMN 9:

Line 17, "matters" should read --matter--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*